US006543418B2

(12) United States Patent
Lavy

(10) Patent No.: US 6,543,418 B2
(45) Date of Patent: Apr. 8, 2003

(54) PROCESS FOR OPTIMIZING THE COMBUSTION OF AN INTERNAL-COMBUSTION ENGINE RUNNING UNDER SELF-IGNITION CONDITIONS

(75) Inventor: Jacques Lavy, Guillancourt (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 0 days.

(21) Appl. No.: 09/987,847

(22) Filed: Nov. 16, 2001

(65) Prior Publication Data

US 2002/0059918 A1 May 23, 2002

(30) Foreign Application Priority Data

Nov. 20, 2000 (FR) ..... 00 15040

(51) Int. Cl.[7] ..... F02M 51/00
(52) U.S. Cl. ..... 123/435; 701/104; 701/111
(58) Field of Search ..... 123/435; 701/104, 701/111

(56) References Cited

U.S. PATENT DOCUMENTS 4,232,643 A * 11/1980 Leshner et al. ..... 123/435
4,417,556 A * 11/1983 Latsch ..... 123/435
4,535,740 A * 8/1985 Ma ..... 123/435
5,535,722 A * 7/1996 Graessley et al. ..... 123/435
6,047,681 A 4/2000 Scherer et al. ..... 123/406.46
6,119,654 A 9/2000 Heiselbetz et al. ..... 123/350

FOREIGN PATENT DOCUMENTS

WO 99/40296 8/1999 ..... F01L/13/00

* cited by examiner

*Primary Examiner*—Erick Solis
(74) *Attorney, Agent, or Firm*—Antonelli, Terry, Stout & Kraus, LLP

(57) ABSTRACT

The present invention relates to a process for optimizing the combustion of an internal-combustion engine running under controlled self-ignition conditions, wherein the state of the combustion of an air/fuel mixture in combustion chamber (14) is measured and, after processing the measuring signals sent to a logical processing unit (46), at least one combustion control parameter is adjusted so as to obtain the desired combustion for the next cycles. The process includes several parameters to be adjusted are determined to optimize the combustion, said parameters are divided into fast parameters (PR) and slow parameters (PL), the fast parameters (PR) are managed by means of a control loop specific to said parameters and the slow parameters (PL) are managed by means of a control loop specific to the slow parameters to obtain the desired combustion for the next cycles.

35 Claims, 1 Drawing Sheet

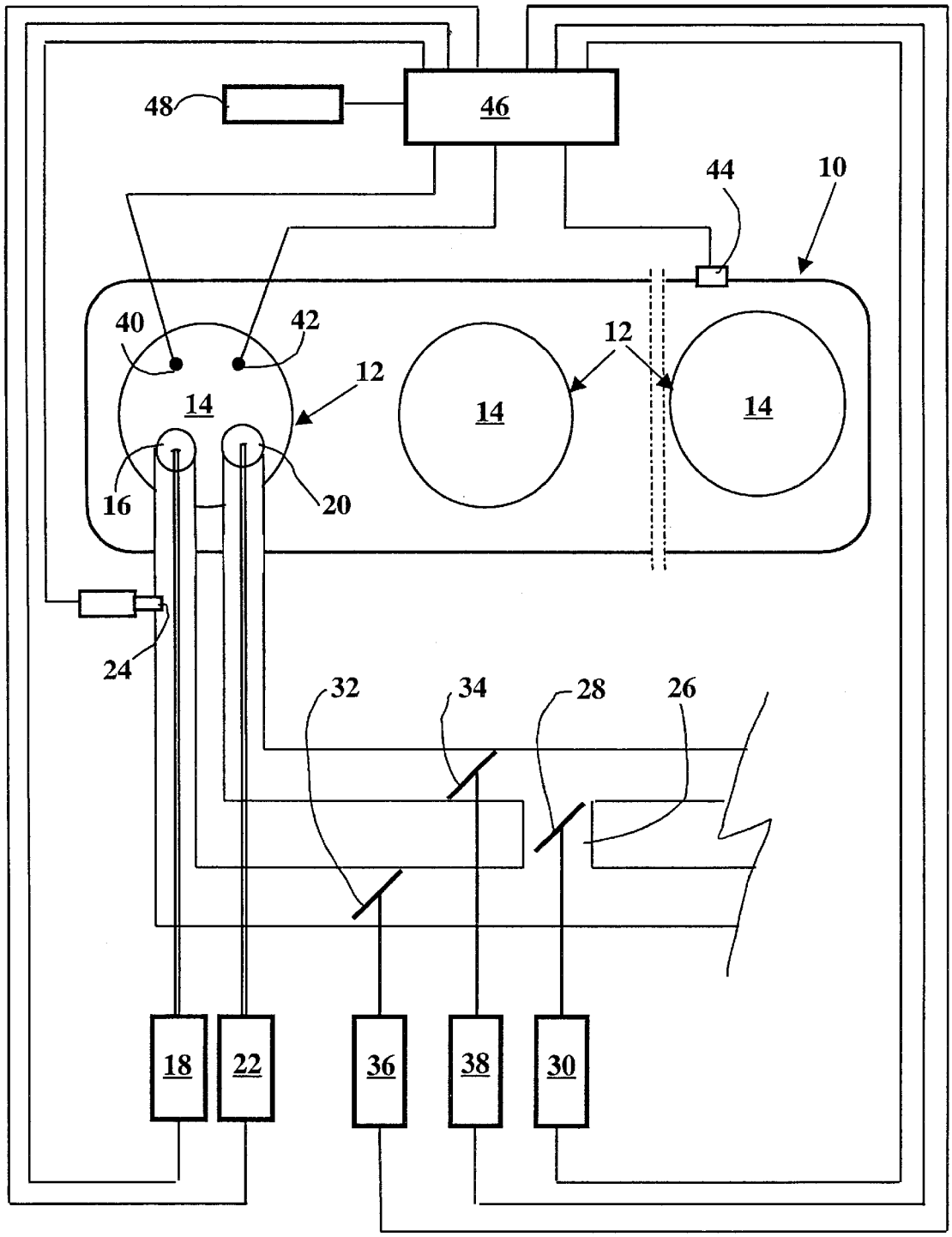
48
46
44
10
40
42
12
14
12
14
14
16
20
24
32
34
28
26
18
22
36
38
30

PROCESS FOR OPTIMIZING THE COMBUSTION OF AN INTERNAL-COMBUSTION ENGINE RUNNING UNDER SELF-IGNITION CONDITIONS

BACKGROUND OF THE INVENTION

1. Field Of The Invention

The present invention relates to a process for optimizing the combustion of an internal-combustion engine running under controlled self-ignition conditions.

2. Description of the Prior Art

Self-ignition is a well-known phenomenon in two-stroke engines which affords advantages concerning emissions since low hydrocarbon and nitrogen oxides emissions are notably obtained.

Concerning four-stroke engines, during self-ignition combustion, very low nitrogen oxides emissions can be obtained, as well as a remarkable cycle regularity.

Self-ignition is a phenomenon which allows initiation of the combustion by means of the residual burnt gases present in the combustion chamber after combustion.

This self-ignition is achieved by controlling the amount of residual burnt gases and mixing thereof with the fresh gases. The residual gases, which are hot burnt gases, initiate combustion of the fresh gases by means of a temperature combination and of the presence of active species (radicals).

In two-stroke engines, the presence of residual gases is inherent in the combustion.

In fact, when the load of the engine decreases, the amount of fresh gases decreases and the fresh gases are naturally replaced by an amount of residual burnt gases from the previous combustion cycle or cycles that have not left the cylinder.

The two-stroke engine thus runs with an internal recirculation (or internal EGR) of the burnt gases at partial load.

However, the presence of this internal EGR is not sufficient to obtain the desired self-ignition running; work on this subject has shown that mixing between this internal EGR and the fresh gases also has to be controlled and notably limited.

The controlled self-ignition technology applied to four-stroke engines is particularly interesting because it allows operation of the engine with an extremely diluted mixture, with very low fuel-air ratios and very low nitrogen oxides emissions.

A high-efficiency and low-pollution engine requires an optimum combustion, whatever the running conditions (speed, load, ambient temperature, hygrometry, ), aging and fouling of the engine.

The criteria to be optimized are mainly the combustion timing in the cycle and the rate of progress of this combustion.

In the case of a controlled self-ignition engine, the combustion is not initiated by a spark whose time of appearance can be controlled, but by the evolution of the thermodynamic and chemical conditions of the air and fuel mixing process during the compression stroke.

According to the variations of this evolution, the combustion can be adjusted early in the cycle and progress less quickly.

It is therefore necessary to adjust various combustion control parameters in order to permanently optimize the progress of this combustion. Document WO 99/40,296 proposes a process for operating a compression ignition engine that allows control of the air/fuel ratio of the mixture present in the combustion chamber by modifying the compression ratio by means of an adjustable intake element such as the intake valve with which such an engine is usually equipped.

The state of the combustion is therefore measured, then the closure time of the intake valve of the combustion chamber is adjusted for the next cycle according to the signal resulting from this measurement.

The process described in this document only allows adjustment of the compression alone or associated with other parameters, and for the next cycle, which implies adjustments of these parameters whose response time is shorter than the combustion cycle length.

SUMMARY OF THE INVENTION

The present invention is a process for optimizing the combustion, which accounts for certain parameters necessary to obtain an ideal combustion and their specific response times.

The process according to the invention is therefore characterized in that:

- several parameters to be adjusted are determined to optimize the combustion,
- the parameters are divided into fast parameters and slow parameters,
- the fast parameters are managed by means of a control loop specific to the parameters and the slow parameters are managed by means of a control loop specific to the slow parameters to obtain the desired combustion for the next cycles.

By means of this process, all of the pertinent parameters in the combustion chamber of the controlled self-ignition engine can be controlled by accounting for their specific response times as regards combustion.

These parameters are notably the amount of air admitted, the amount of fuel, the global and local air/fuel ratio, the amount of internal burnt gases and the degree of mixing of internal burnt gases with the fresh gases, the dilution of the fresh gases by external recirculated burnt gases, . . . etc.

More particularly, the slow parameters are controlled and the fast parameters are controlled by accounting for the slow parameters control.

By means of this characteristic, the inadequate adjustment of the slow parameters can be compensated by the suitable adjustment of the fast parameters, which eventually allows obtaining the desired combustion, whatever the running conditions.

More particularly, the slow parameters have a longer response time than the fast parameters.

The response time of the fast parameters is preferably at most equal to the length of a determined number of combustion cycles.

According to the invention, the parameters to be adjusted are determined by comparison of a reference frame for an ideal combustion contained in the unit and processing of the signals sent by at least one combustion state detector.

More particularly, the signals come from a combustion state detector and/or from a knock detector and/or from a pressure detector.

According to an aspect of the invention, the processing unit corrects the slow parameters so that the fast parameters remain within boundary values.

Thus, as the engine is operated and as it evolves with time (fouling, aging), the control process automatically corrects certain slow parameters such as, for example, the burnt gas recirculation, so that the variations of the fast parameters remain within acceptable predetermined boundary values (such as the opening and closure time of the valves in the case of an electromechanical or electrohydraulic type valve gear).

BRIEF DESCRIPTION OF THE FIGURE

Other features and advantages of the invention will be clear from reading the description hereafter, with reference to the sole accompanying FIGURE which illustrates a non-limitative embodiment example and diagrammatically shows a self-ignition combustion engine using the process according to the invention.

DETAILED DESCRIPTION OF THE PREFERRED EMBODIMENTS OF THE INVENTION

In this FIGURE, internal-combustion engine 10 comprises a cylinder block provided with four cylinders 12 forming, with the piston and the cylinder head (not shown), a combustion chamber 14.

Each combustion chamber 14 is provided with at least one intake port provided with a valve 16 whose opening and closure are controlled by an intake actuator 18 and with at least one exhaust port provided with a valve 20 controlled by an exhaust actuator 22.

Actuators 18 and 22 are of electromechanical or electrohydraulic type, with a response time in proportion to the engine cycle, but they can also be of mechanical type, with a continuous variation of the lift and/or of the phase angle of the valves, with a response time of the order of several cycles.

In the case of the example described, the fuel injection is an indirect injection, i.e. this fuel is injected upstream from intake valve 16 by an injector 24 provided with an injection actuator.

Furthermore, external recirculated burnt gases, or external EGR, are allowed to pass into the intake port provided with valve 16 by means of a line 26 that communicates with the exhaust gases resulting from the combustion in cylinders 14, and which comprises a control valve 28 controlled by a burnt gas actuator 30.

A flow rate control is also provided in the intake and exhaust ports; in the example described here, this control valves 32, 34 actuated by flow actuators 36, 38.

Furthermore, a combustion state detector 40, which is for example an ionic current detector allowing measurement of the electric conductivity of the combustion gases, is arranged in the combustion chamber and allows continuous measurement of the combustion progress.

A pressure detector 42 measures the pressure prevailing in the combustion chamber and can also serve as a combustion analysis device and will be possibly used in parallel with detector 40.

The engine can also comprise a detector 44 which measures the amplitude of the vibrations generated during unwanted combustions in case of knock.

A processing unit 46 evaluates the state of the combustion and the evolution thereof as a function of the signal received from combustion state detector 40 and/or from knock detector 44 and/or from pressure detector 42.

In addition, the processing unit 46 receives, through logical unit 48, information relative to the running conditions of the engine, such as the mean and instantaneous speed, the air flow rate, the air/fuel ratio, the flow rate of the external recirculated burnt gases, the valve lift and timing, the temperature of the cooling liquid, the oil temperature, the temperature of the intake air.

According to the signals/information received and after processing thereof by processing unit 46, control signals are sent to the various actuators 18, 22, 24, 30, 36 and 38 in order to obtain in the combustion chamber, for the next cycles, the conditions for an ideal combustion of the air/fuel mixture.

In order to know the state of the combustion during a cycle, the processing unit 46 thus receives, at the beginning of the combustion cycle, signals from at least one is detector 40, 42, 44.

According to the signals received and to their evolution during this cycle, processing unit 46 processes these signals and determines, on the basis of a reference frame contained in its regulation logic, the combustion parameters that have to be modified in order to obtain an ideal combustion state.

Once the parameters to be modified are determined, processing unit 46 divides them into two categories: slow parameters PL and fast parameters PR.

In some cases, according to the state of the combustion, it may occur that the processing unit 46 has no parameter to be classified in one or the other of these categories.

Processing unit 46 therefore has to manage only fast parameters or only slow parameters.

The slow parameters are the parameters whose response time is longer than that of other parameters.

Of course, the response time is understood to be either the response time of the adjustment actuators associated with the parameters they control, or the time required to obtain effective modification of the parameter considered in the combustion chamber.

By way of example, the fast parameters PR are those whose response time is shorter than or equal to the length of a determined number of combustion cycles, whereas the slow parameters PL are those whose response time is longer than the length of this number of cycles, this number ranging from 1 to 2.

Still by way of example, the fast parameters are the air/fuel ratio controlled by injector 24, the air mass admitted and the internal aerodynamics adjusted by the valve gear by means of valve actuators 18, 22.

The slow parameters are notably the intake pressure managed by intake flow actuator 36 and valve 32, the exhaust back pressure controlled by exhaust flow actuator 38 and valve 34, the dilution of the air/fuel mixture by the external burnt gases managed by burnt gas actuator 30 and associated valve 28.

Once the parameters are determined and classified, processing unit 46 manages these parameters.

In cases where only fast parameters PR or slow parameters PL have been determined, the processing unit 46 manages adjustment of these parameters by a control loop comprising the processing unit, the adjustment actuator associated with the parameter to be modified and the detector(s) provides knowledge of the state of the combustion.

More particularly, processing unit 46 sends a control signal to the actuator which adjusts the parameter considered, such as the actuator controlling the fuel injection 24, then detector 40 and/or 42 and/or 44 controls the progress of the combustion and sends a signal to the processing unit 46 that processes the signal.

On the other hand, if the processing unit 46 has determined and classified fast parameters and slow parameters to optimize the combustion, the processing unit is going to manage the slow parameters by means of the control loop and send control signals to part of the actuators to control adjustment of slow parameters PL, such as burnt gas actuator 30 that acts upon valve 28 so as to modify the proportion of burnt gases sent to the intake port and thus to modify the dilution of these gases in the air/fuel mixture present in the combustion chamber.

In combination with this step, processing unit 46 manages actuators which adjust the fast parameters PR also by means of a control loop, by taking into account the influence of the control of slow parameters PL on the combustion.

The processing unit 46 thus controls part of the actuators which adjust the fast parameters PR, such as, for example, intake actuator 18 acting upon intake valve 16, so as to compensate for the inadequate adjustment of the slow parameters and to obtain the desired combustion.

Of course, the engine is going to evolve with time and the processing unit 46 automatically corrects the adjustment of certain slow parameters so that the adjustment variation of fast parameters remains within acceptable boundary values, still with a view to the desired combustion.

The invention described above is applied to an indirect-injection internal-combustion engine, but this invention applies just as well to a direct-injection combustion engine.

The intake of external recirculated burnt gases is also mentioned, a re-circulation that is to be understood as coming from either the exhaust manifold or directly from another combustion chamber of a cylinder of the engine.

What is claimed is:

1. A process for optimizing the combustion of an internal-combustion engine running under controlled self-ignition conditions, wherein a state of combustion of an air/fuel mixture in a combustion chamber is measured and, after processing of measuring signals sent to a processing unit, at least one combustion control parameter is adjusted to obtain a desired combustion for subsequent cycles, comprising:

determining parameters to be adjusted to optimize the combustion;

dividing the determined parameters into fast parameters and slow parameters; and managing the fast parameters by a control loop specific to the fast parameters and the slow parameters by a control loop specific to the slow parameters to obtain the desired combustion for the subsequent cycles.

2. A combustion optimization process as claimed in claim 1, wherein: the slow parameters are controlled; and the fast parameters are controlled by accounting for the slow parameters control.

3. A combustion optimization process as claimed in claim 1, wherein the slow parameters have a longer response time than the fast parameters.

4. A combustion optimization process as claimed in claim 3, wherein the response time of the fast parameters is at most equal to a length of a set number of combustion cycles.

5. A combustion optimization process as claimed in claim 1, wherein the parameters to be adjusted are determined by comparison of a reference frame for an ideal combustion modeled in the processing unit and processing of signals sent by at least one combustion state detector.

6. A combustion optimization process as claimed in claim 5, wherein the signals come from at least one of a combustion state detector, a knock detector and a pressure detector.

7. A combustion optimization process as claimed in claim 1, wherein the processing unit corrects the slow parameters so that the fast parameters remain within boundary values.

8. A combustion optimization process as claimed in claim 2, wherein the slow parameters have a longer response time than the fast parameters.

9. A combustion optimization process as claimed in claim 8, wherein the response time of the fast parameters is at most equal to a length of a set number of combustion cycles.

10. A combustion optimization process as claimed in claim 2, wherein the parameters to be adjusted are determined by comparison of a reference frame for an ideal combustion modeled in the processing unit and processing of signals sent by at least one combustion state detector.

11. A combustion optimization process as claimed in claim 3, wherein the parameters to be adjusted are determined by comparison of a reference frame for an ideal combustion modeled in the processing unit and processing of signals sent by at least one combustion state detector.

12. A combustion optimization process as claimed in claim 4, wherein the parameters to be adjusted are determined by comparison of a reference frame for an ideal combustion modeled in the processing unit and processing of signals sent by at least one combustion state detector.

13. A combustion optimization process as claimed in claim 8, wherein the parameters to be adjusted are determined by comparison of a reference frame for an ideal combustion modeled in the processing unit and processing of signals sent by at least one combustion state detector.

14. A combustion optimization process as claimed in claim 9, wherein the parameters to be adjusted are determined by comparison of a reference frame for an ideal combustion modeled in the processing unit and processing of signals sent by at least one combustion state detector.

15. A combustion optimization process as claimed in claim 10, wherein the signals come from at least one of a combustion state detector, a knock detector and a pressure detector.

16. A combustion optimization process as claimed in claim 11, wherein the signals come from at least one of a combustion state detector, a knock detector and a pressure detector.

17. A combustion optimization process as claimed in claim 12, wherein the signals come from at least one of a combustion state detector, a knock detector and a pressure detector.

18. A combustion optimization process as claimed in claim 13, wherein the signals come from at least one of a combustion state detector, a knock detector and a pressure detector.

19. A combustion optimization process as claimed in claim 14, wherein the signals come from at least one of a combustion state detector, a knock detector and a pressure detector.

20. A combustion optimization process as claimed in claim 3, wherein the processing unit corrects the slow parameters so that the fast parameters remain within boundary values.

21. A combustion optimization process as claimed in claim 4, wherein the processing unit corrects the slow parameters so that the fast parameters remain within boundary values.

22. A combustion optimization process as claimed in claim 5, wherein the processing unit corrects the slow parameters so that the fast parameters remain within boundary values.

23. A combustion optimization process as claimed in claim 6, wherein the processing unit corrects the slow parameters so that the fast parameters remain within boundary values.

24. A combustion optimization process as claimed in claim 8, wherein the processing unit corrects the slow parameters so that the fast parameters remain within boundary values.

25. A combustion optimization process as claimed in claim 9, wherein the processing unit corrects the slow parameters so that the fast parameters remain within boundary values.

26. A combustion optimization process as claimed in claim 10, wherein the processing unit corrects the slow parameters so that the fast parameters remain within boundary values.

27. A combustion optimization process as claimed in claim 11, wherein the processing unit corrects the slow parameters so that the fast parameters remain within boundary values.

28. A combustion optimization process as claimed in claim 12, wherein the processing unit corrects the slow parameters so that the fast parameters remain within boundary values.

29. A combustion optimization process as claimed in claim 13, wherein the processing unit corrects the slow parameters so that the fast parameters remain within boundary values.

30. A combustion optimization process as claimed in claim 14, wherein the processing unit corrects the slow parameters so that the fast parameters remain within boundary values.

31. A combustion optimization process as claimed in claim 15, wherein the processing unit corrects the slow parameters so that the fast parameters remain within boundary values.

32. A combustion optimization process as claimed in claim 16, wherein the processing unit corrects the slow parameters so that the fast parameters remain within boundary values.

33. A combustion optimization process as claimed in claim 17, wherein the processing unit corrects the slow parameters so that the fast parameters remain within boundary values.

34. A combustion optimization process as claimed in claim 18, wherein the processing unit corrects the slow parameters so that the fast parameters remain within boundary values.

35. A combustion optimization process as claimed in claim 19, wherein the processing unit corrects the slow parameters so that the fast parameters remain within boundary values.

* * * * *